US005564708A

United States Patent [19]

Hwang

[11] Patent Number: 5,564,708

[45] Date of Patent: Oct. 15, 1996

[54] GOLF BALL

[75] Inventor: In H. Hwang, Seoul, Rep. of Korea

[73] Assignee: Ilya Co., Ltd., Seoul, Rep. of Korea

[21] Appl. No.: 359,445

[22] Filed: Dec. 20, 1994

[30] Foreign Application Priority Data

Sep. 6, 1994 [KR] Rep. of Korea ..... 1994-22294

[51] Int. Cl.[6] ..... A63B 37/14

[52] U.S. Cl. ..... 473/382; 473/384

[58] Field of Search ..... 273/232; 40/327

[56] References Cited

U.S. PATENT DOCUMENTS

| | | | |
|---|---|---|---|
| 4,974,856 | 12/1990 | Morell | 273/232 |
| 5,024,444 | 6/1991 | Yamagishi et al. | 273/232 |
| 5,087,049 | 2/1992 | Yamagishi et al. | 273/232 |

*Primary Examiner*—George J. Marlo
*Attorney, Agent, or Firm*—Dorsey & Whitney LLP

[57] ABSTRACT

The invention relates to a golfball having a plurality of dimples in its outer spherical surface The dimples have various sizes and depths and are configured in a pattern that is based upon dividing the golfball's surface into a spherical octahedron having eight octahedral triangles and a spherical hexaoctahedron having eight hexaoctahedral triangles and six hexaoctahedral quadrangles. The two poles of the golfball are located within centers of oppositely facing octahedral triangles ("pole triangles"). The remaining six octahedral triangles ("equator triangles") are intersected by the golfball's equator through the two of their three midpoints that are not in contact with the pole triangles.

Six dimples of equal size (having equivalent diameters) are placed in a circle around the centers of each of the eight octahedral triangles. A plurality of dimples having equal size are uniformly placed along the three great circles that define the octahedron, except that no dimple is to be placed along or overlap the golfball's forming joint region, which is incident to the equator. In addition, a dimple of the largest size is placed adjacent to each apex of each of the eight octahedral triangles. A dimple of the largest size is also placed next to each midpoint of each side within each of the two pole triangles. Also, a dimple of the second largest size is placed next to each midpoint of each side within each of the six equator triangles.

20 Claims, 7 Drawing Sheets

GOLF BALL

FIELD OF THE INVENTION

This invention relates to a golf ball having stable flight and superior distance characteristics attributable to its dimple configuration within its outer, spherical surface.

BACKGROUND OF THE INVENTION

In general, the aerodynamic characteristics of a golfball are governed by the pattern of its dimples, as well their associated shapes, sizes, and depths. Therefore, in order to obtain an aerodynamically optimal surface, one must consider each of these factors in formulating a dimple configuration.

Currently, various dimple configurations exist in which, for example, dimples are avoided or evenly overlapped on selected great circles, which are circles on the golfball's surface that are formed by the intersection of planes that pass through the center of the golfball. The purpose of these patterns is to increase the golfball's flight stability, as well as its distance. This increase in the golfball's flight stability and distance is based on the assumption that the ball will rotate around a virtual axis, which is an axis that is perpendicular to any one of the planes of selected great circles. However, in practice, the ball may not actually rotate about one of these axes because golfers frequently fail to properly align the ball (with respect to selected great circles) upon the tee before striking it. In fact, actual rotation might occur around an axis far from a virtual one. This problem, however, can be at least partially alleviated with strategic selection and placement of dimples upon the ball's spherical surface.

The dimple pattern on the surface of a golfball is essential mainly for the ball's physical symmetry. In addition, it is important to efficiently arrange dimples to lessen aerodynamic resistance of the ball. Moreover, the balanced arrangement of dimples of proper shape and depth without sacrificing flight stability is most important.

Generally speaking, dimples having a large diameter serve to enhance lift, thus enabling the ball to fly higher and consequently travel farther. On the other hand, deep dimples having a small diameter stabilize the flight but draw low trajectories.

In constructing a golf ball cover, it is inevitable to have a forming joint. The joint is buffed and cleaned. The actual buffed width could easily be greater than 0.2 mm. Therefore, the diameter of the equator (the great circle centered within the forming joint) differs, albeit slightly, from those of the other great circles, thus leading to different airflow aspects. Therefore, it is critical that in the dimple arrangement, the dimpled area and non-dimpled equator are properly balanced, with respect to one another.

Thus, great importance is placed upon the dimple arrangement including the associated pattern, along with the various dimple sizes and depths. The present invention adjusts size, displacement, and depth of dimples in connection with dimple patterns to attain improved aerodynamic balance and flight stability with overall longer flight distances.

SUMMARY OF THE INVENTION

This invention relates to golf balls having dimple patterns which are symmetrical about the forming joint of the golf ball cover.

In defining a pattern for one embodiment of this invention, the cover of a spherical golf ball is initially divided (figuratively) into four spherical equilateral triangles to make a tetrahedron. Then the midpoint of each side of the four triangles are joined with straight spherical line segments while the spherical line segments constituting the sides of the original four triangles are figuratively erased from the model. This results in eight equilateral, spherical triangles, which make an octahedron. Next, similar to the previous step, the midpoint of each side of the eight octahedral triangles are joined with straight spherical line segments. These spherical line segments, taken alone, result in six spherical quadrangles and eight spherical triangles, thus forming a hexaoctahedron. Two basic patterns, the octahedron and the hexaoctahedron, now figuratively exist upon the surface of the golfball.

The present invention is primarily based upon the octahedral pattern with one pole of the golfball located in the middle of an octahedral triangle and the other pole found in the middle of the opposite octahedral triangle. Accordingly, the equator (the great circle incidental to the forming joint) passes through the midpoints of the sides of the remaining six octahedral triangles that are not also sides of the pole triangles. A dimple may or may not be placed at the poles. Including the poles, the centers of the octahedral triangles could either have a dimple or not have a dimple. Six uniformly shaped dimples of equal size (diameter) and shape are arranged in a circle around and right next to the centers of each of the eight octahedral triangle. Additional dimples of equal size and shape are uniformly distributed along the three great circles that define the eight spherical triangles of the octahedron. However, no dimple is to be positioned along the equator or to overlap the forming joint.

The largest dimples are found adjacent to the apexes and right next to the midpoints of each side of the eight octahedral triangles. However, these largest dimples may be replaced by the second largest dimple if the dimples are placed within hexaoctahedral triangles that adjoin the equator. This substitution enables dimples to be placed within equator octahedral triangles in patterns similar to those of the pole octahedral triangles, without overlapping the forming joint. The purposes of the larger dimples is to gain easy lift of the ball while in rotation, as well as to increase both flight distance and stability.

With respect to the size of the dimples, the dimple diameters of the largest dimples are configured to be greater than or equal to 1.1 times the diameter of the second largest dimples yet less than 1.3 times that same diameter. A golf ball which is made according to the present invention, thus having dimple symmetry about the equator, has proven to have greater flight stability and distance characteristics.

DETAILED DESCRIPTION OF THE PREFERRED EMBODIMENT

Figure 5:
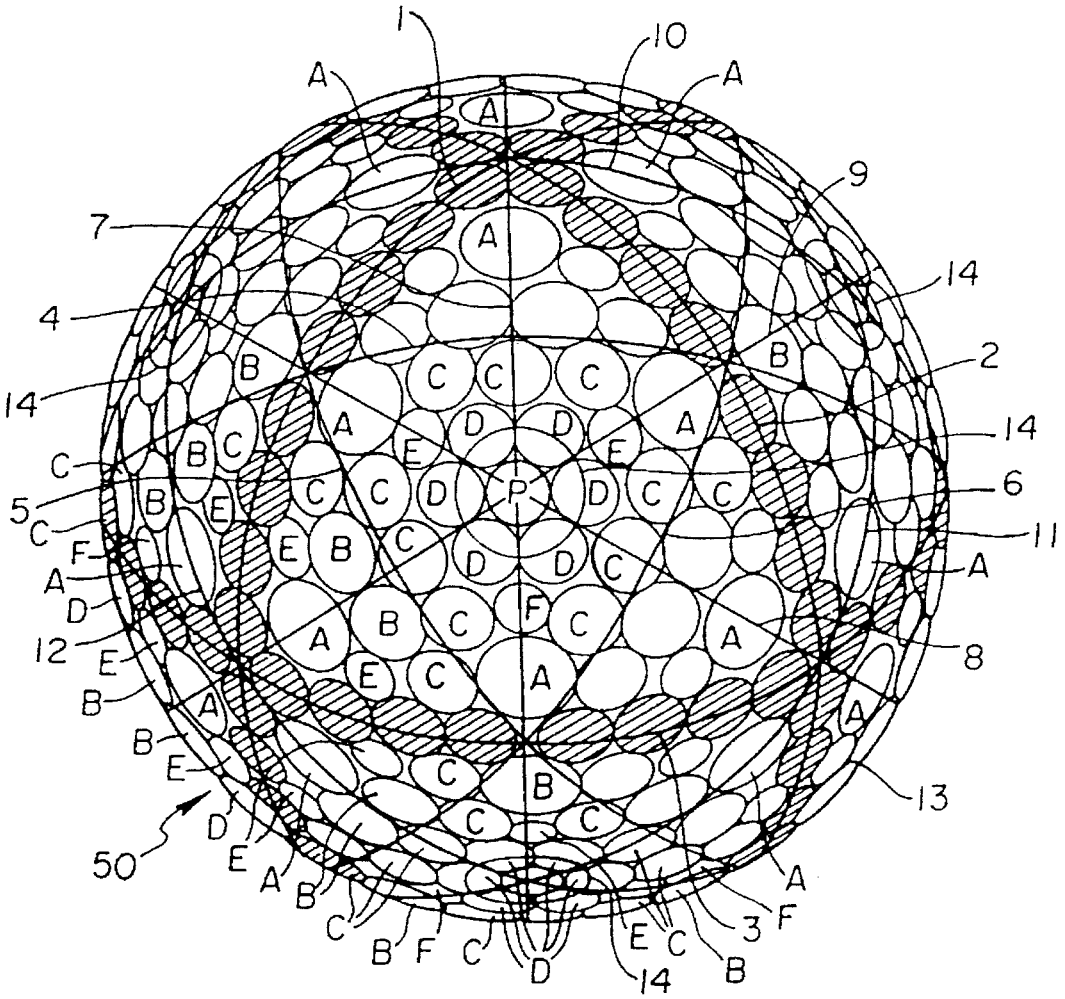
FIG. 5 is a perspective view of a golf ball surface from a pole. Dimples having a size, shape and depth are arranged along the three great circles that divide the surface into eight spherical triangles of an octahedron. There is no dimple at the center of the octahedral triangle and six dimples having the same size and shape are arranged in a circle around and right next to the center of the triangle.
Figure 6:
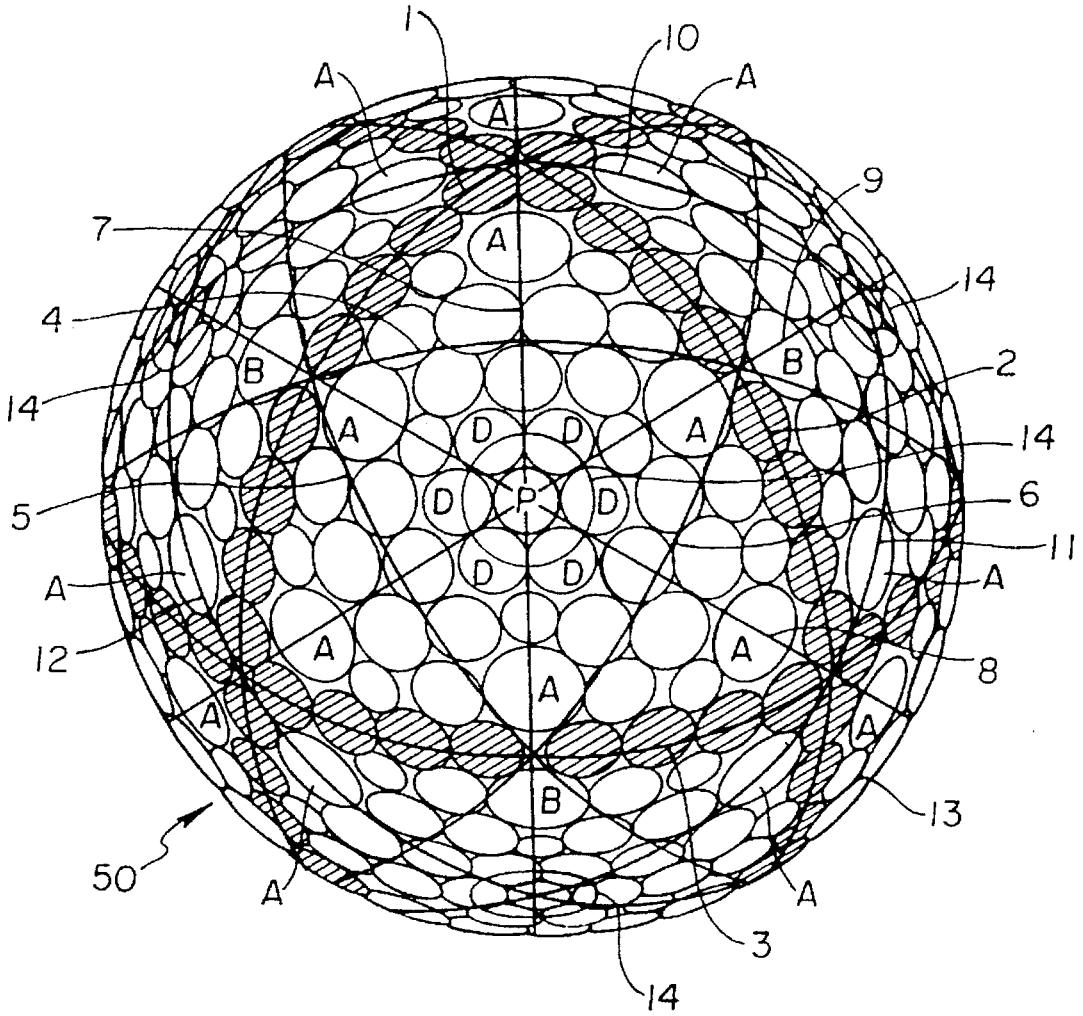
FIG. 6 shows the existence of a dimple at the center of a spherical triangle, which is the major difference with FIG. 5. This figure features the arrangement of the largest dimples.
Figure 7:
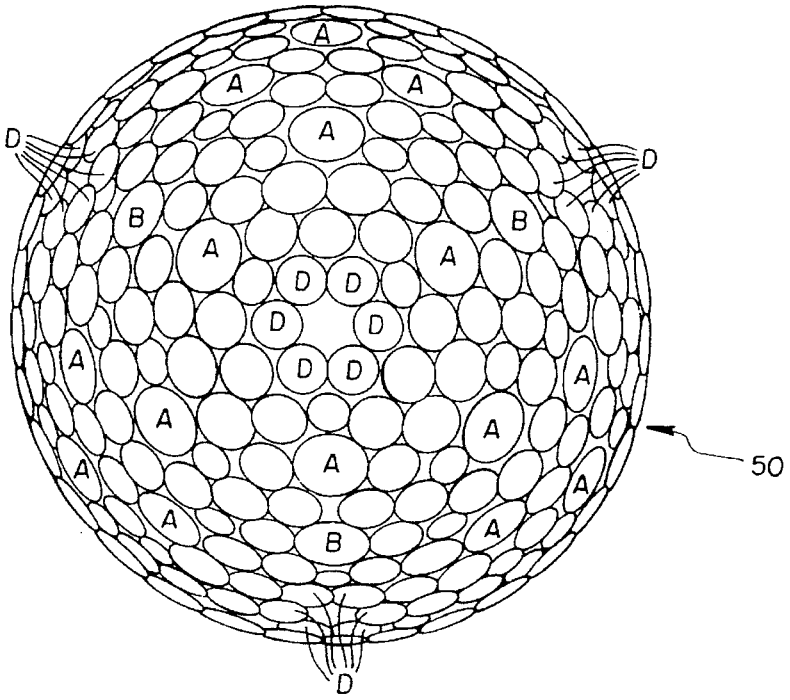
FIG. 7 is a perspective view of a golf ball surface from a pole and a final draft which eliminates lines dividing spherical surfaces. Emphasis is placed on the location and arrangement of dimples in circle and the arrangement of the largest dimples.

As shown in FIGS. 5 to 7, the present invention relates to a golf ball 50 having a plurality of dimples A, B, C, D, E, and F with varying sizes, depths, and patterns. The dimple placements and patterns are primarily based upon figuratively dividing the golfball's surface into eight spherical, equilateral triangles to make an octahedron and placing the dimples into the surface with relation to the triangles, as well as to the equator 13, which is the great circle centered within the ball's forming joint 15. Therefore, one must initially derive the octahedron pattern upon the golfball's surface in order to define the dimples positioning. (Note that these triangle lines do not necessarily appear upon the golfball, but rather, are used figuratively to define dimple placement.)

Figure 1A:
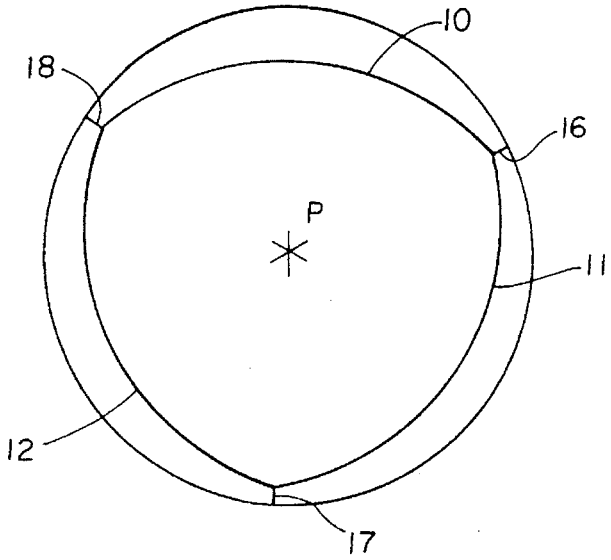
FIGS. 1A to 1C are bottom, top, and side perspective views, respectively, depicting a spherical surface divided into a tetrahedron.
Figure 1B:
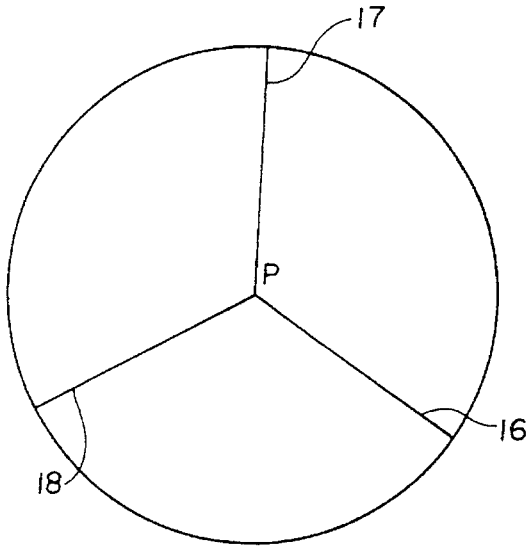
Figure 1C:
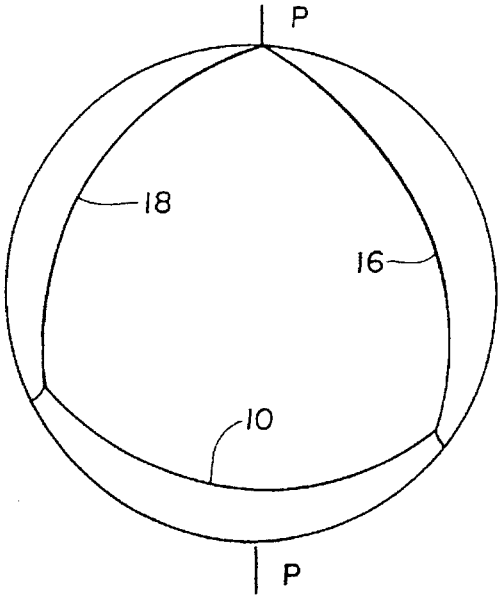
Figure 2A:
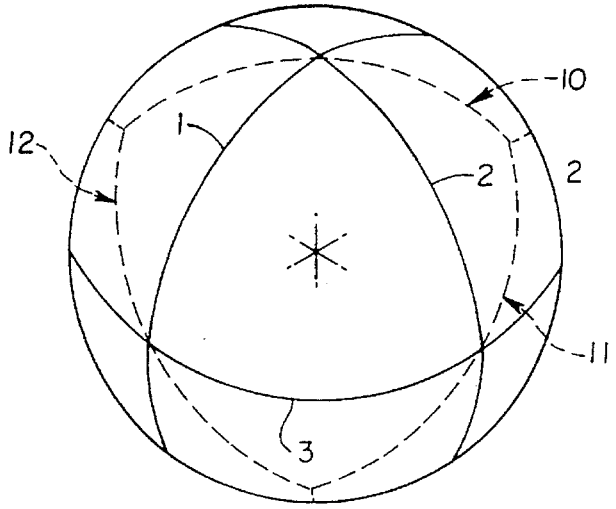
FIGS. 2A to 2C are bottom, top, and side perspective vies, respectively, depicting a spherical surface further divided into an octahedron consisting of eight spherical, octahedral triangles.
Figure 2B:
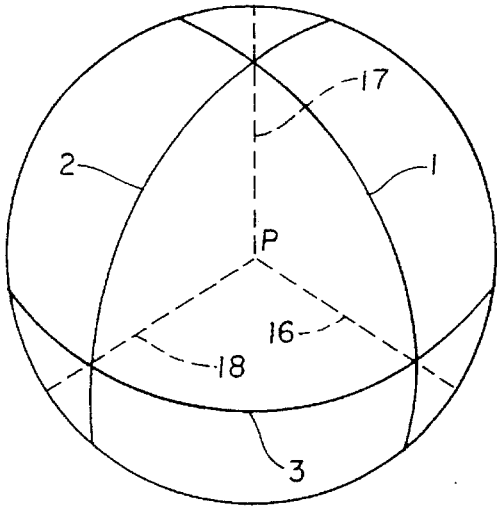

As shown in FIGS. 1A to 1C, line segments 10, 11, 12, 16, 17, and 18 divide the surface of a spherical golfball 50 into four spherical, equilateral triangles to make a tetrahedron. Next, (with reference to FIGS. 2A to 2C) the midpoint of each side of each of these tetrahedral triangles are joined with straight, spherical line segments while the spherical line segments constituting the sides of the original four triangles are figuratively erased from the model. As shown in FIGS. 2A and 2B, the resulting configuration is a spherical octahedron, which is composed of eight spherical triangles. With reference to FIGS. 2, 3, 5 and 6, the spherical octahedral triangles are comprised of great circles 1, 2 and 3.

Figure 2C:
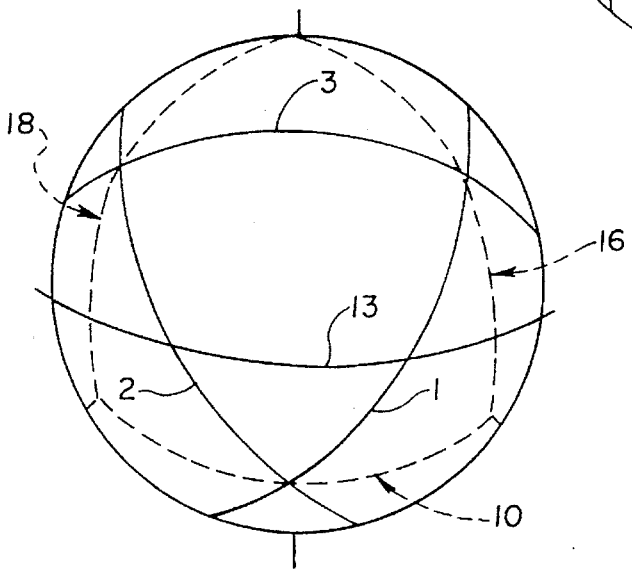
Figure 3A:
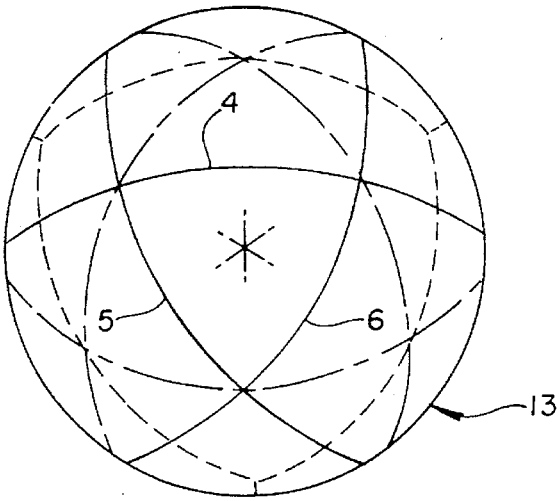
FIGS. 3A to 3C are bottom, top, and side perspective vies, respectively, depicting a spherical surface further divided into a hexaoctahedron consisting of eight spherical, hexaoctahedral triangles and six hexaoctahedral quadrangles.
Figure 3B:
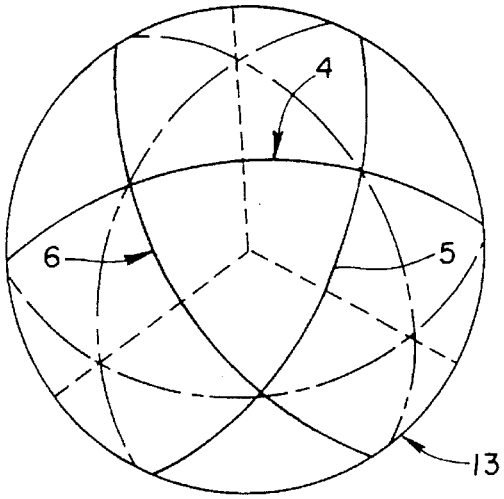

The ball 50 includes two poles P, each of which is centered within oppositely-facing octahedral triangles (one being depicted in FIGS. 1A, 2A, 3A, 5, 6, and 7 while the other is depicted in FIGS. 1B, 2B, and 3B. With reference to FIG. 2C, the other six octahedral triangles are intersected through two of their midpoints by the equator 13, which is the great circle that is centered within the forming joint 15 of the golfball.

Figure 3C:
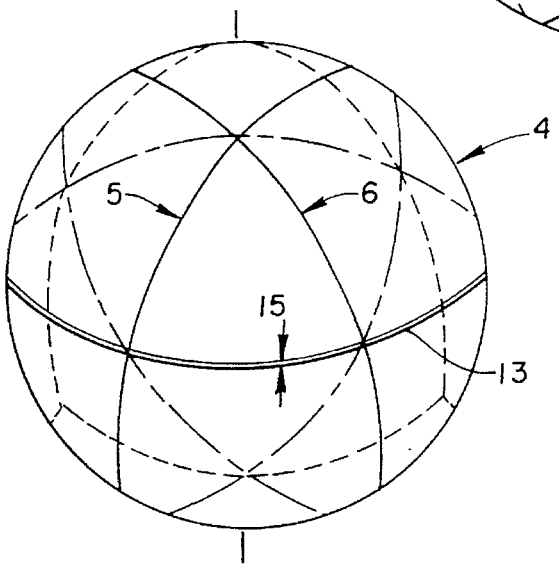

With reference to FIGS. 3A, 3B, and 3C, the midpoints of each side of each octahedral triangles are joined with straight spherical line segments. Taken alone, these segments form four great circles: 4, 5, 6, and the equator 13. In turn, these four great circles define six spherical quadrangles and eight spherical triangles, making a hexaoctahedron.

One embodiment of this invention utilizes six different dimple sizes (diameters): A, B, C, D, E, and F, where A>B>C>D>E>F. More particularly, the diameter of a given dimple size should equal a value that is between 1.1 and 1.3 times greater than the diameter of the next largest size, e.g., $1.1B \leqq A \leqq 1.3B$ and $1.1E \leqq D \leqq 1.3E$. It should be noted, however, that this relation defines a possible diameter range for a given size, but dimples of a given size classification (e.g., C dimples) are equivalent in size (i.e., diameter) with one another.

As stated above, the present invention is essentially based upon the alignment of dimples in relation to the eight triangle, octahedron pattern. Again, among the eight octahedral triangles, two triangles ("pole" triangles) contain a pole P at their center, while the remaining six triangles ("equator" triangles) are intersected by the equator 13 through the two of their three midpoints that are not adjacent to a pole triangle.

For the following dimple placement description, general reference should be made to FIGS. 4 through 7. With one embodiment of this invention, the uniformly shaped round C-sized dimples are arranged along (i.e., atop) the sides of all eight octahedral triangles, formed by great circles 1, 2, and 3. Note, however, that no dimples should be placed at the equator 13 or overlap the associated forming joint 15.

Figure 4A:
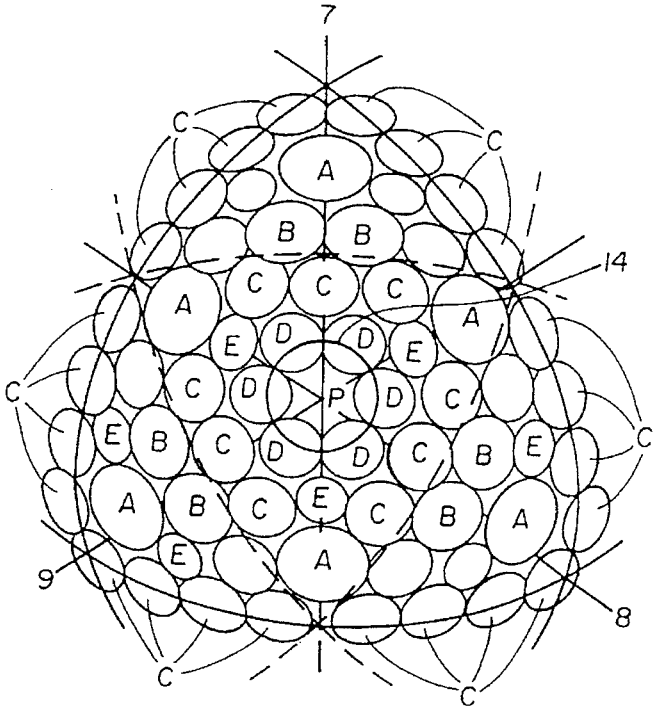
FIGS. 4A and 4B are perspective views of an octahedral pole and an octahedral equator triangle, respectively, with their associated dimple configurations.
Figure 4B:
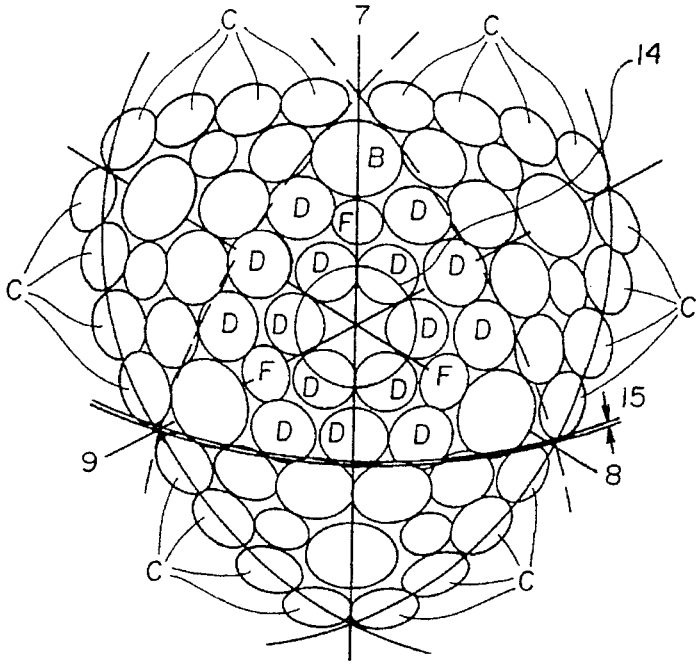

Reference should be made to FIGS. 4A and 4B for dimple placement within the octahedral triangles. Around the centers of the eight octahedral triangles, six uniformly shaped D-sized dimples are arranged so that when each center of the dimple is connected, a circle 14 is formed. Circle 14 could vary in size depending on the diameter of the dimples. A dimple may or may not be placed at each pole P within the circles 14. However, both poles P must either include or not include a dimple. Likewise, the octahedral equator triangles may or may not contain a dimple within their circles 14, but all six equator triangles must either contain or not contain such a dimple. If a dimple is placed within circles 14, it should be larger (e.g. a C-sized dimple) than the dimples forming the circles 14. These D-sized dimples which form circle 14 don't intersect great circles 7, 8, and 9, which result from joining the midpoints of each side of the octahedral triangles to facing apexes. This feature helps the golf ball to not lose distance performance due to changing axis of spin aroused by air resistance. In other words, the golf ball can overcome the air resistance with the spin gained by the strike.

Among the D-sized dimples arranged in a circle 14, the dimples of the same displacement in the octahedral triangles could possibly be varied depending on whether the triangle has a pole because the present invention adopts the equator as the axis of symmetry and tries to aerodynamically balance the golfball's surface about the buffed forming joint region 15. Therefore, the dimple arrangement in the octahedral pole triangles should be identical to one another. Likewise, the dimple arrangement of the octahedral equator triangles should also be identical with one another.

An A-sized dimple is placed adjacent to the midpoint of each side and adjacent to each apex of the two octahedral pole triangles. Similarly, an A-sized dimple should be placed adjacent to each apex of each of the six remaining equator triangles. (Refer to FIG. 4B for dimple placement of an octahedral equator triangle.) However, no A-sized dimple is placed next to the side midpoints of these equator triangles because no dimple is to overlap the forming joint 15. Rather, a B-sized dimple should be placed adjacent to the midpoint of each side of these octahedral equator triangles. Remember, these B-sized dimples should not overlap the forming joint region 15. Note that these midpoint dimples (A-sized for pole triangles and B-sized for equator triangles) are located within the apexes of the smaller hexaoctahedral triangles that were formed within each octahedral triangle.

For the two pole triangles, C-sized dimples are placed circularly around and adjacent to the D-sized dimples of circles 14, except that an E-sized dimple should be placed adjacent to each of the three midpoint A-sized dimples so that each lies directly between the center of the triangle and its corresponding A-sized triangle. (Note that these C-sized dimples are positioned adjacent to the interior sides of the smaller hexaoctahedral triangles, which have been formed within the octahedral triangles.) This same basic dimple placement applies to the six equator triangles except that D-sized dimples are substituted for C-sized dimples and F-sized dimples are substituted for E-sized dimples. In other words, D-sized, rather than C-sized dimples are placed adjacent to the interior sides of the smaller hexaoctahedral triangles lying within each of the octahedral equator triangles. Again, no dimple should overlap the forming joint region 15. Also, an F-sized rather than an E-sized dimple is placed adjacent to each of the three B-sized dimples that are positioned within the apexes of the smaller hexaoctahedral triangles lying within the equator triangles so that each F-sized dimple lies directly between the center of the octahedral (or hexaoctahedral triangle) and the corresponding B-sized dimple.

The space that remains within the eight octahedral triangles (including both the two pole triangles and the six equator triangles) is outside of the smaller hexaoctahedral triangles. This space may be filled with dimples as depicted in FIGS. 4 through 7. However, as previously stated, dimple configurations for the two pole triangles must be identical to one another just as dimple configurations for the remaining six equator triangles must also be identical to one another.

An important aspect of the present invention is the size of the A-sized dimple. Because of the relative size and placement of the A-sized dimples, one could easily achieve the desired aerodynamic balance between the equator 13 and the rest of the surface simply by making the A-sized dimples significantly larger than the other dimples. However, an A-sized dimple should be limited in size to minimize the amount of surface area not containing a dimple. It has been found that an optimal compromise between these two opposing considerations is to make the diameter of the A-sized dimple a value between 1.1 and 1.3 times greater than the diameter of a B-sized dimple. This size relation is the same for the other dimples.

Figure 8:
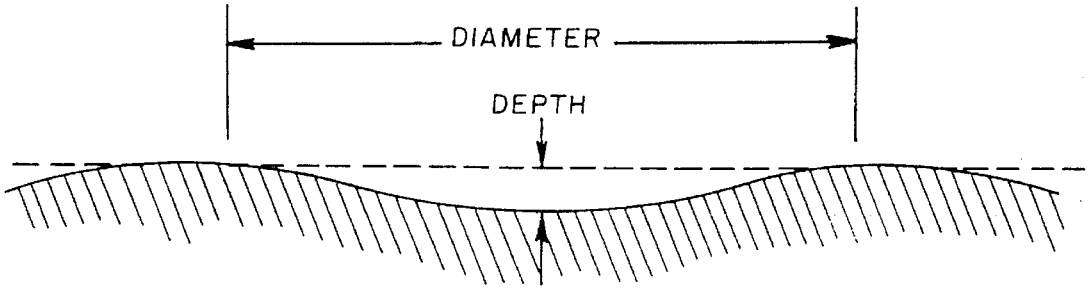
FIG. 8 features the relation of dimple diameter to the depth.

Another important aspect of this invention is the depth (see FIG. 8) of the dimples. The depth of each dimple, along with its surface area (assuming each dimple is of identical shape) will determine the dimple's volume. The area ratio, for a given dimple size, is defined as:

$$\frac{\Sigma \text{ area of all placed dimples of a given size}}{\Sigma \text{ area of all of the placed dimples}}$$

In turn, the volume ratio for a given dimple size is defined as:

$$\frac{\Sigma \text{ volume of all placed dimples of a given size}}{\Sigma \text{ volume of all of the placed dimples}}$$

The depth of a given dimple size should be chosen to make the area ratio for that size equivalent to its volume ratio. For example, if the area ratio of an A-sized dimple, which is described as:

$$\frac{\Sigma \text{ area of all placed A-sized dimples}}{\Sigma \text{ area of all placed dimples}}$$

is equivalent to 0.15, then the volume ratio for the A-sized dimple, which is described as:

$$\frac{\Sigma \text{ volume of all placed A-sized dimples}}{\Sigma \text{ volume of all placed dimples}}$$

must also be equal to 0.15. Also, the depth (see FIG. 8) of a dimple for a given size should fall between 3 to 8 percent of that size's corresponding dimple diameter.

With the arrangement and the depths of dimples as described, the golf ball is aerodynamically balanced throughout its surface, about the equator, and thus, will have greater flight stability and distance characteristics.

While the preferred embodiment of the present invention has been described, it should be appreciated that various modifications may be made by those skilled in the art without departing from the spirit and scope of the present invention. Accordingly, reference should be made to the claims to determine the scope of the present invention.

What is claimed is:

1. A golfball having a generally spherical outer surface, the surface being figuratively divided into (1) an octahedron having eight spherical octahedral triangles defined by three octahedral great circles (1, 2, and 3), wherein two oppositely-facing octahedral triangles are "pole" triangles, each containing a pole P at its center, while the remaining six octahedral triangles are "equator" triangles, each being intersected through two of its midpoints by an equator 13, which is the great circle that is centered within the golfball surfaces forming joint region 15, and (2) a hexaoctahedron having eight smaller spherical hexaoctahedral triangles and six spherical quadrangles defined by four hexaoctahedral great circles (4, 5, 6, and the equator 13), the surface including a plurality of dimples from a possible set of A-sized, B-sized, C-sized, and D-sized dimples, wherein the dimples of a given size have substantially equivalent diameters with the various dimple sizes having the comparative diameter relation: A>B>C>D, the golfball, within its outer spherical surface, comprising:

six dimples of one given size (from the possible set of dimples) arranged substantially in a circle 14 around each of the centers of the eight octahedral triangles;

a multiplicity of dimples of one given size (from the possible set of dimples) uniformly positioned along the octahedral great circles (1, 2, and 3) without overlapping the forming joint region 15;

an A-sized dimple positioned adjacent to each apex of each of the eight octahedral triangles;

an A-sized dimple positioned adjacent to each midpoint of each side of and interior to the two octahedral pole triangles;

a B-sized dimple positioned adjacent to each midpoint of each side of and interior to the six octahedral equator triangles; and the dimple configurations of the two octahedral pole triangles being substantially identical to one another and the dimple configurations of the six octahedral equator triangles being substantially identical to one another, wherein no dimple overlaps the forming joint region 15.

2. The golfball of claim 1, wherein the octahedral triangles have no dimples at their centers.

3. The golfball of claim 1, wherein the two octahedral pole triangles have dimples at their centers.

4. The golfball of claim 1, wherein the A-sized dimple diameter is between 1.1 and 1.3 times greater than the B-sized dimple diameter.

5. The golfball as defined in claim 1, wherein the dimples arranged substantially in a circle around the octahedral triangle centers are D-sized and the multiplicity of dimples uniformly positioned along the octahedral great circles are C-sized.

6. The golfball as defined in claim 5, wherein the A-sized dimple diameter is between 1.1 and 1.3 times greater than the B-sized dimple diameter, the B-sized dimple diameter is between 1.1 and 1.3 times greater than the C-sized dimple diameter, and the C-sized dimple diameter is between 1.1 and 1.3 times greater than the D-sized dimple diameter.

7. The golfball of claim 1, wherein the dimples of a given size have substantially equivalent depths, the depth for each dimple of a given size being selected to obtain substantial equality between area and volume ratios for the given dimple size.

8. The golfball of claim 7, wherein the depth of a dimple for a given dimple size is between 3 and 8 percent of that dimple's corresponding diameter.

9. The golfball of claim 1, wherein the configuration of dimples within the smaller hexaoctahedral triangles that are within the six octahedral equator triangles are substantially equivalent to the configurations within the smaller hexaoctahedral triangle within the two octahedral pole triangles, except that within the equator hexaoctahedral triangles, as compared to the pole hexaoctahedral triangles, B-sized dimples are substituted for A-sized dimples and D-sized dimples are substituted for C-sized dimples.

10. The golfball of claim 1, further comprising E-sized and F-sized dimples located on the golfball's outer spherical surface, wherein the E-sized dimples are smaller than the D-sized dimples and the F-sized dimples are smaller than the E-sized dimples.

11. The golfball of claim 10, wherein the configuration of dimples within the smaller hexaoctahedral triangles that are within the six octahedral equator triangles are substantially equivalent to the configurations within the smaller hexaoctahedral triangles within the two octahedral pole triangles, except that within the hexaoctahedral equator triangles, as compared to the hexaoctahedral pole triangles, B-sized dimples are substituted for A-sized dimples, D-sized dimples are substituted for C-sized dimples, and F-sized simples are substituted for E-sized dimples.

12. A golfball having a generally spherical outer surface, the surface being figuratively divided into (1) an octahedron having eight spherical octahedral triangles defined by three great circles (1, 2, and 3), wherein two oppositely-facing octahedral triangles are "pole" triangles, each containing a pole P at its center, while the remaining six octahedral triangles are "equator" triangles, each being intersected through two of its midpoints by an equator 13, which is the great circle that is centered within the golfball surface's forming joint region 15, and (2) a hexaoctahedron having eight smaller spherical hexaoctahedral triangles and six spherical quadrangles defined by four great circles (4, 5, 6, and the equator 13), the surface including a plurality of dimples from a possible set of A-sized, B-sized, C-sized and D-sized dimples, wherein the dimples of a given size have substantially equivalent diameters with the various dimple sizes having the comparative diameter relation: A>B>C>D, the golfball, within its outer spherical surface, comprising:

six D-sized dimples arranged substantially in a circle 14 around each of the centers of the eight octahedral triangles;

a multiplicity of C-sized dimples uniformly positioned along the octahedral great circles (1, 2, and 3) without overlapping the forming joint region 15;

an A-sized dimple positioned adjacent to each apex of each of the eight octahedral triangles;

an A-sized dimple positioned adjacent to each midpoint of each side of and interior to the two octahedral pole triangles;

a B-sized dimple positioned adjacent to each midpoint of each side of and interior to the six octahedral equator triangles; and the dimple configurations of the two octahedral pole triangles being substantially identical to one another and the dimple configurations of the six octahedral equator triangles being substantially identical to one another, wherein no dimple overlaps the forming joint region 15.

13. The golfball as defined in claim 12,wherein the A-sized dimple diameter is between 1.1 and 1.3 times greater than the B-sized dimple diameter, the B-sized dimple diameter is between 1.1 and 1.3 times greater than the C-sized dimple diameter, and the C-sized dimple diameter is between 1.1 and 1.3 times greater than the D-sized dimple diameter.

14. The golfball of claim 13, wherein the dimples of a given size have substantially equivalent depths, the depth for each dimple of a given size being selected to obtain substantial equality between area and volume ratios for the given dimple size.

15. The golfball of claim 14, wherein the depth of a dimple for a given dimple size is between 3 and 8 percent of that dimple's corresponding diameter.

16. The golfball of claim 12, wherein the configuration of dimples within the smaller hexaoctahedral triangles that are within the six octahedral equator triangles are substantially equivalent to the configurations within the smaller hexaoctahedral triangle within the two octahedral pole triangles, except that within the equator hexaoctahedral triangles, as compared to the pole hexaoctahedral triangles, B-sized dimples are substituted for A-sized dimples and D-sized dimples are substituted for C-sized dimples.

17. A golfball having a generally spherical outer surface, the surface being figuratively divided into (1) an octahedron having eight spherical octahedral triangles defined by three great circles (1, 2, and 3), wherein two oppositely-facing octahedral triangles are "pole" triangles, each containing a pole P at its center, while the remaining six octahedral triangles are "equator" triangles, each being intersected through two of its midpoints by an equator 13, which is the great circle that is centered within the golfball surface's forming joint region 15, and (2) a hexaoctahedron having eight smaller spherical hexaoctahedral triangles and six spherical quadrangles defined by four great circles (4, 5, 6, and the equator 13), the surface including a plurality of dimples from a possible set of A-sized, B-sized, C-sized, D-sized, E-sized and F-sized dimples, wherein the dimples of a given size have substantially equivalent diameters with the various dimple sizes having the comparative diameter relation: A>B>C>D>E>F, the golfball, within its outer spherical surface, comprising:

six D-sized dimples arranged substantially in a circle 14 around each of the centers of the eight octahedral triangles;

a multiplicity of C-sized dimples uniformly positioned along the octahedral great circles (1, 2, and 3) without overlapping the forming joint region 15;

an A-sized dimple positioned adjacent to each apex of each of the eight octahedral triangles;

an A-sized dimple positioned adjacent to each midpoint of each side of and interior to the two octahedral pole triangles;

a B-sized dimple positioned adjacent to each midpoint of each side of and interior to the six octahedral equator triangles;

a plurality of E-sized and F-sized dimples; and the dimple configurations of the two octahedral pole triangles being substantially identical to one another and the dimple configurations of the six octahedral equator triangles being substantially identical to one another, wherein no dimple overlaps the forming joint region 15.

18. The golfball as defined in claim 17, wherein the A-sized dimple diameter is between 1.1 and 1.3 times greater than the B-sized dimple diameter, the B-sized dimple diameter is between 1.1 and 1.3 times greater than the C-sized dimple diameter, and the C-sized dimple diameter is between 1.1 and 1.3 times greater than the D-sized dimple diameter.

19. The golfball of claim 18, wherein the dimples of a given size have substantially equivalent depths, the depth for each dimple of a given size being selected to obtain substantial equality between area and volume ratios for the given dimple size.

20. The golfball of claim 17, wherein the configuration of dimples within the smaller hexaoctahedral triangles that are within the six octahedral equator triangles are substantially equivalent to the configurations within the smaller hexaoctahedral triangle within the two octahedral pole triangles, except that within the equator hexaoctahedral triangles, as compared to the pole hexaoctahedral triangles, B-sized dimples are substituted for A-sized dimples and D-sized dimples are substituted for C-sized dimples and F-sized dimples are substituted for E-sized dimples.

* * * * *